US009108296B2

(12) United States Patent
Whang et al.

(10) Patent No.: US 9,108,296 B2
(45) Date of Patent: Aug. 18, 2015

(54) SUBSTRATE PROCESSING APPARATUS AND METHOD OF OPERATING THE SAME

(75) Inventors: Jong Kwang Whang, Yongin (KR); Sung Gyu Kim, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 645 days.

(21) Appl. No.: 13/137,555

(22) Filed: Aug. 25, 2011

(65) Prior Publication Data

US 2012/0282845 A1 Nov. 8, 2012

(30) Foreign Application Priority Data

May 4, 2011 (KR) ..... 10-2011-0042698

(51) Int. Cl.
*B24C 7/00* (2006.01)
*B24C 1/04* (2006.01)
*B24C 3/04* (2006.01)

(52) U.S. Cl.
CPC ..... *B24C 7/0038* (2013.01); *B24C 1/045* (2013.01); *B24C 3/04* (2013.01); *B24C 7/0084* (2013.01)

(58) Field of Classification Search
CPC .... B24C 1/045; B24C 7/0084; B24C 7/0038; B24C 3/04
USPC ..... 451/5, 36, 38, 99, 102; 83/53, 177
See application file for complete search history.

(56) References Cited

U.S. PATENT DOCUMENTS 3,691,695 A * 9/1972 Green et al. ..... 451/2
3,877,334 A * 4/1975 Gerber ..... 83/22
3,978,748 A * 9/1976 Leslie et al. ..... 83/53
4,468,160 A * 8/1984 Campbell, Jr. ..... 409/202
4,555,872 A * 12/1985 Yie ..... 451/40
4,728,379 A * 3/1988 Audi et al. ..... 156/106
4,738,174 A * 4/1988 Bloomquist ..... 83/53
4,945,688 A * 8/1990 Yie ..... 451/102
5,199,342 A * 4/1993 Hediger ..... 83/177
5,472,367 A * 12/1995 Slocum et al. ..... 451/5
5,765,759 A * 6/1998 Bruns et al. ..... 239/398
5,785,582 A * 7/1998 Stefanik et al. ..... 451/102
5,851,139 A * 12/1998 Xu ..... 451/102
5,857,398 A * 1/1999 Bando ..... 83/879
6,155,245 A * 12/2000 Zanzuri ..... 125/12
6,222,155 B1 * 4/2001 Blackmon et al. ..... 219/121.39
6,390,106 B1 * 5/2002 Lin ..... 134/172
7,527,692 B2 * 5/2009 Nakagawa et al. ..... 118/313
2002/0066345 A1 * 6/2002 Shepherd et al. ..... 83/53
2003/0037650 A1 * 2/2003 Knaupp et al. ..... 83/53
2008/0110312 A1 * 5/2008 Knaupp et al. ..... 83/177
2008/0216625 A1 * 9/2008 Li et al. ..... 83/72
2011/0232442 A1 * 9/2011 Guglielmetti et al. ..... 83/53

FOREIGN PATENT DOCUMENTS

JP 06-023670 A 2/1994
KR 10-2006-0096973 A 9/2006
KR 10-2010-0037690 A 4/2010

* cited by examiner

*Primary Examiner* — Lee D Wilson
*Assistant Examiner* — Tyrone V Hall, Jr.
(74) *Attorney, Agent, or Firm* — Lee & Morse, P.C.

(57) ABSTRACT

Provided is a substrate processing apparatus including a first conduit configured to supply a processing solution to a substrate loaded on a supporter, and a second conduit in fluid communication with the first conduit, the second conduit configured to supply a gas to the first conduit to be mixed with the processing solution, wherein the first conduit includes an opening to permit the processing solution mixed with the gas to be injected onto the substrate.

16 Claims, 7 Drawing Sheets

SUBSTRATE PROCESSING APPARATUS AND METHOD OF OPERATING THE SAME

CROSS-REFERENCE TO RELATED APPLICATIONS

This U.S. non-provisional patent application claims priority under 35 U.S.C. §119 to Korean Patent Application No. 10-2011-0042698, filed on May 4, 2011, in the Korean Intellectual Property Office, the entire contents of which are hereby incorporated by reference.

BACKGROUND OF THE INVENTION

Embodiments of the inventive concepts relate to a substrate processing apparatus and a method of operating the same.

As the electronic industry becomes more and more advanced, a demand for electronic devices with high reliability and high performance is increasing. However, owing to an increase in manufacturing cost, it is not easy to satisfy this demand.

Accordingly, research has been conducted to discover ways for reducing the manufacturing costs of electronic parts or devices related to a substrate processing apparatus and a method of operating the same.

SUMMARY

According to example embodiments, a substrate processing apparatus may include a first conduit configured to supply a processing solution to a substrate loaded on a supporter, and a second conduit in fluid communication with the first conduit, the second conduit configured to supply a gas to the first conduit to be mixed with the processing solution, wherein the first conduit includes an opening to permit the processing solution mixed with the gas to be injected onto the substrate.

In some embodiments, the processing solution may include water and an abrasive material. In other embodiments, the supporter may include a top surface for supporting the substrate, and further comprising a head unit surrounding the opening of the first conduit and being movable along a vertical direction perpendicular to the top surface of the supporter.

In still other embodiments, the head unit may include an internal space adjacent to the opening, and the processing solution mixed with the gas may be injected onto the substrate via the internal space. The apparatus may further include a third conduit coupled to the head unit, the third conduit configured for supplying an abrasive material into the internal space of the head unit.

In yet other embodiments, the apparatus may further include a first transferring unit configured to move the head unit along a first direction. The first transferring unit may include a guide rail extending along the first direction, and a support load coupled with the guide rail. The support load may be movable along the first direction.

In further embodiments, the supporter may include first and second sidewalls facing each other and extending along the first direction. The guide rail may include first and second guide rails provided on the first and second sidewalls of the supporter, respectively. The support load may include a first portion coupled with the first guide rail to extend along a third direction, a second portion coupled with the second guide rail to extend along the third direction, and a third portion connecting the first and second portions with each other and extending along a second direction. The first and second directions may be perpendicular to each other, and the third direction may be perpendicular to the top surface of the supporter.

In still further embodiments, the apparatus may further include a second transferring unit coupled with the third portion of the support load and configured to move the head unit along the second direction.

In even further embodiments, the substrate may include at least one of a touch screen panel, a glass substrate, and flexible substrate. In yet further embodiments, the supporter may be configured to support a plurality of the substrates loaded thereon, and the opening may be configured to permit the processing solution mixed with the gas to be injected onto the plurality of the substrates.

In a further embodiment, the apparatus may include a processing solution supplying portion in fluid communication with the first conduit and configured to supply the processing solution at a pressure higher than ambient pressure.

According to other example embodiments, a method of processing a substrate may include increasing a pressure of a processing solution supplied into a conduit to above ambient pressure, supplying a gas into the processing solution to form a processing solution mixed with the gas, and injecting the processing solution mixed with the gas onto the substrate.

In some embodiments, the injecting of the processing solution mixed with the gas may include injecting an abrasive material onto the at least one substrate, along with the processing solution mixed with the gas.

In other embodiments, the at least one substrate may include a plurality of substrates, and the processing solution mixed with the gas may be used to cut the plurality of substrates.

In still other embodiments, the plurality of substrates may be curvedly cut to form a curved edge.

In yet other embodiments, the processing solution mixed with the gas may be used to remove contaminants from the substrate.

BRIEF DESCRIPTION OF THE DRAWINGS

Example embodiments will be more clearly understood from the following brief description taken in conjunction with the accompanying drawings.

FIG. 1 illustrates a perspective view of a substrate processing apparatus according to example embodiments of the inventive concepts;

FIG. 2 illustrates a perspective view of the substrate processing apparatus in use, according to example embodiments;

FIG. 3 illustrates a flowchart of a method of operating a substrate processing apparatus according to example embodiments;

FIG. 4 illustrates a sectional view of a head unit of the substrate processing apparatus shown in FIG. 1;

FIG. 5 illustrates a sectional view of a head unit of a substrate processing apparatus according to embodiments;

FIG. 6 illustrates a perspective view of a substrate processing apparatus according to other example embodiments; and FIG. 7 illustrates a sectional view of a head unit of the substrate processing apparatus shown in FIG. 6.

Figure 1:
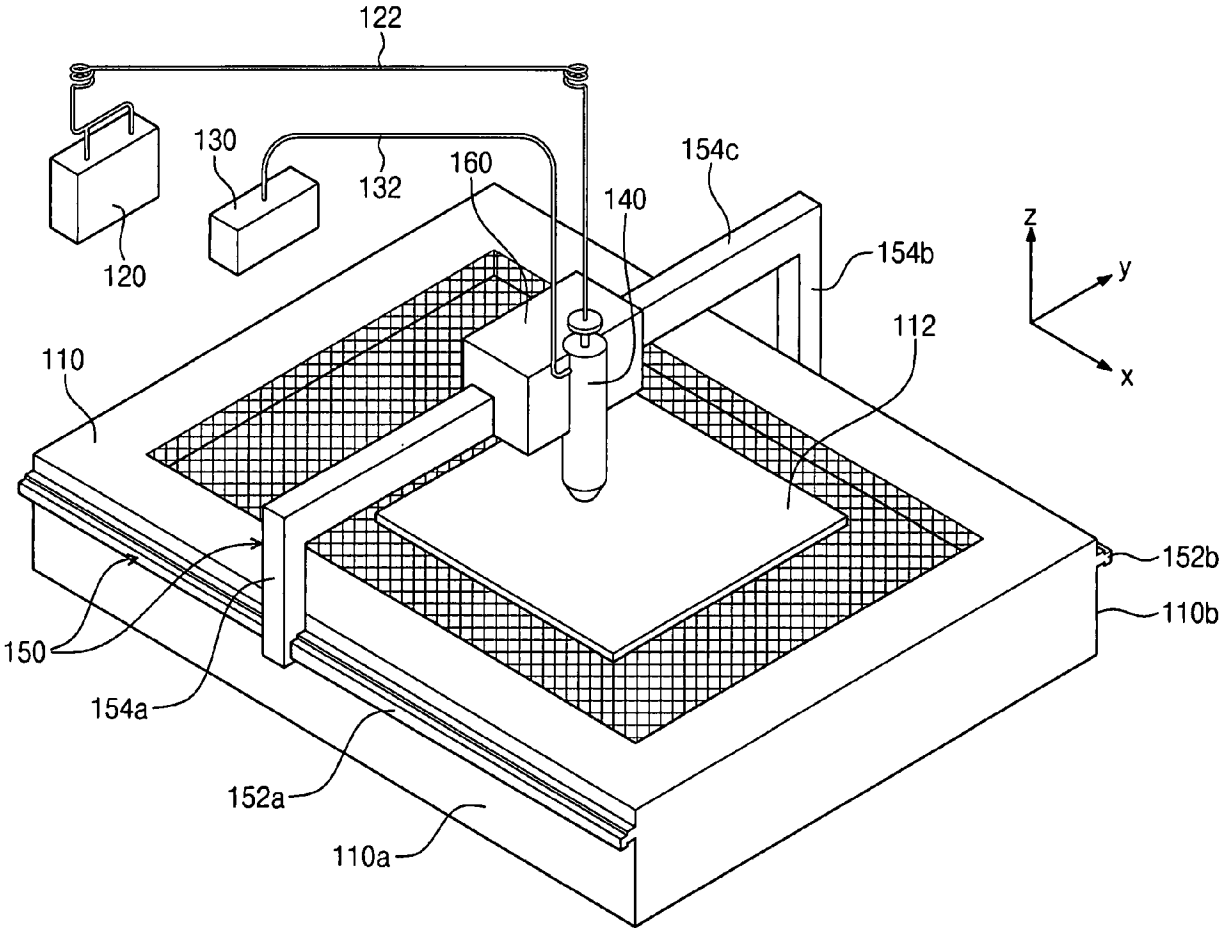
FIGS. 1 through 7 represent non-limiting, example embodiments as described herein.

It should be noted that these figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. For example, the relative thicknesses and positioning of molecules, layers, regions and/or structural elements may be reduced or exaggerated for clarity. The use of similar or identical reference numbers in the various drawings is intended to indicate the presence of a similar or identical element or feature.

DETAILED DESCRIPTION

Example embodiments will now be described more fully with reference to the accompanying drawings, in which example embodiments are shown. Example embodiments may, however, be embodied in many different forms and should not be construed as being limited to the embodiments set forth herein; rather, these embodiments are provided so that this disclosure will be thorough and complete, and will fully convey the concept of example embodiments to those of ordinary skill in the art. In the drawings, the thicknesses of layers and regions are exaggerated for clarity. Like reference numerals in the drawings denote like elements, and thus their description will be omitted.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Like numbers indicate like elements throughout. As used herein the term "and/or" includes any and all combinations of one or more of the associated listed items. Other words used to describe the relationship between elements or layers should be interpreted in a like fashion (e.g., "between" versus "directly between," "adjacent" versus "directly adjacent," "on" versus "directly on").

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises", "comprising", "includes" and/or "including," if used herein, specify the presence of stated features, integers, steps, operations, elements and/or components, but do not preclude the presence or addition of one or more other features, integers, steps, operations, elements, components and/or groups thereof.

Example embodiments are described herein with reference to cross-sectional illustrations that are schematic illustrations of idealized embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle may have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments of the inventive concepts belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

FIG. 1 illustrates a perspective view of a substrate processing apparatus according to example embodiments.

Referring to FIG. 1, a substrate processing apparatus according to example embodiments may include a supporter 110 configured to support a processing target object, a processing solution supplying portion 120 configured to supply a processing solution, a gas supplying portion 130 configured to supply a gas, a head unit 140 configured to inject the processing solution mixed with the gas, and first and second transferring units 150 and 160 configured to transfer the head unit 140.

The processing target object may be provided on the supporter 110. In some embodiments, the processing target object may be a substrate 112 for realizing a display device. The substrate 112 may include any suitable material, for instance, at least one of a glass substrate, a plastic substrate, and a silicon substrate. Furthermore, the substrate 112 may be a substrate for at least one of a liquid crystal display device, an organic light-emitting display device, and a touch screen panel. In addition, the substrate 112 may be one of a flexible substrate and a non-flexible substrate.

The supporter 110 may include a top surface and a bottom surface opposite the top surface. The top surface of the supporter 110 may be used to support the substrate 112. The supporter 110 may further include side surfaces connecting the top surface and the bottom surface. The side surfaces may include first and second opposing side surfaces **110*a* and 110*b*, which extend along a first direction, and third and fourth opposing side surfaces, which extend along a second direction. The first and second opposing side surfaces may extend between and connect the third and fourth opposing side surfaces. In some embodiments, the first and second directions may be parallel to the top surface of the supporter 110**, and intersecting. In some embodiments, the second direction may be perpendicular to the first direction. For instance, as shown in the drawings, the first and second directions may be parallel to the x- and y-axis directions, respectively. In an implementation, the first and second opposing side surfaces may be perpendicular to the third and fourth opposing side surfaces.

The processing solution supplying portion 120 may supply the processing solution to the head unit 140 via a first conduit 122 connected to the head unit 140. In some embodiments, the processing solution may contain water and an abrasive material. The abrasive material may be supplied to the substrate 112 along with the water to grind the substrate 112.

The gas supplying portion 130 may supply the gas into the first conduit 122 via a second conduit 132 connected to the first conduit 122. The gas may be mixed with the processing solution in the first conduit 122. In some embodiments, the second conduit 132 and the first conduit 122 may be connected to each other in the head unit 140, and the gas may be provided in an air bubble form.

The first transferring unit 150 may include at least one guide rail and at least one support load. In some embodiments, the first transferring unit 150 may be configured to include a plurality of the guide rails. For instance, the first transferring unit 150 may include the first and second guide rails 152*a* and 152*b* opposing each other along the first direction. For example, the first and second guide rails 152*a* and 152*b* may be formed on the first and second side surfaces 110*a* and 110*b*, respectively.

The support load may be configured to be movable along the first direction and engaged with the first and second guide rails 152*a* and 152*b*. In some embodiments, the support load may include first, second and third portions 154*a*, 154*b*, and 154*c*. The first portion 154*a* of the support load may be engaged with the first guide rail 152*a*. The first portion 154*a* may extend along a third direction. The second portion 154*b* of the support load may be engaged with the second guide rail 152*b*. The second portion 154*b* may extend along the third direction. The third direction may be perpendicular to the top surface of the supporter 110. For instance, as shown in the drawings, the third direction may be parallel to the z-axis. In some embodiments, the lengths of the first and second portions 154*a* and 154*b* may be the same. The third portion 154*c* of the support load may be connected to the first and second portions 154*a* and 154*b* along the second direction.

The second transferring unit 160 may be provided on the third portion 154*c* of the first transferring unit 150 and may be movable along a running or second direction along the length of the third portion 154*c*. The head unit 140 may be coupled to the second transferring unit 160. As a result, a movement of the head unit 140 may be constrained by that of the second transferring unit 160. For instance, the head unit 140 may be movable along the second direction with the second transferring unit 160.

The head unit 140 may be movable along the third direction or vertically. In some embodiments, the head unit 140 may be coupled with the second transferring unit 160. According to some of the afore-described embodiments, the head unit 140 may be coupled with the second transferring unit 160 that is movable along the second direction, and the second transferring unit 160 may be coupled with the first transferring unit 150 that is movable along the first direction. As a result, the head unit 140 may be three-dimensionally movable, during injecting or spraying of the processing solution mixed with the gas onto the substrate 112.

In some embodiments, when contaminants are on the substrate 112, the processing solution mixed with the gas may be injected from the head unit 140 to remove the contaminants from the substrate 112.

In other embodiments, the processing solution mixed with the gas may be injected from the head unit 140 to cut the substrate 112, as described with reference to FIG. 2.

Figure 2:
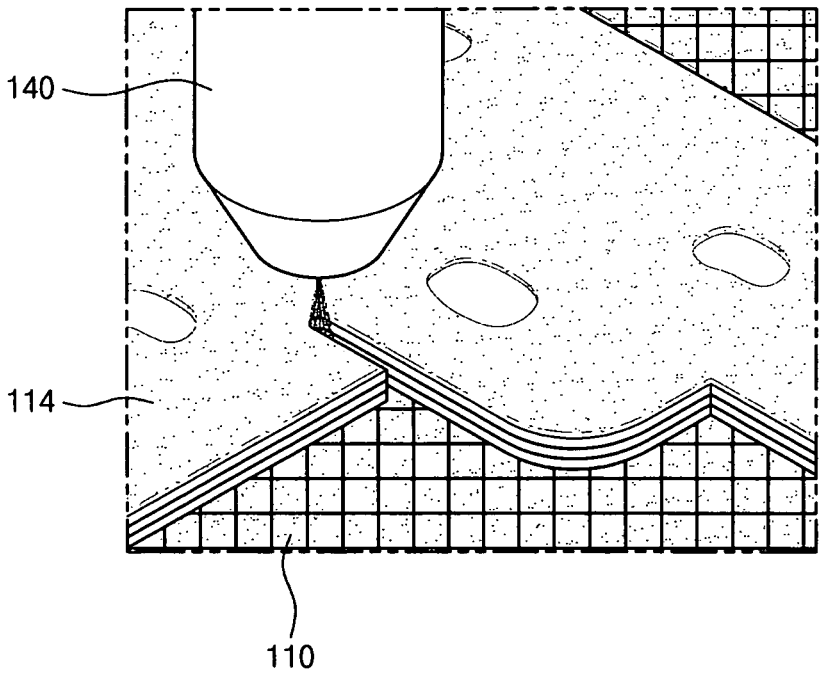

FIG. 2 illustrates a perspective view of the substrate processing apparatus in use, according to example embodiments.

Referring to FIG. 2, the head unit 140 may be configured to inject or spray a processing solution mixed with a gas. The processing solution mixed with the gas may be used to cut a plurality of substrates 114. In some embodiments, the plurality of substrates 114 may be cut linearly along a specific direction by the processing solution mixed with the gas. The substrates 114, once cut in this fashion, may include straight edges. In other embodiments, the plurality of substrates 114 may be cut curvedly by the processing solution mixed with the gas to have a cutting surface of finite curvature. The plurality of substrates 114, once cut in this fashion, may include curved edges. The plurality of substrates 114 may be used in a display device.

The gas and the processing solution may be mixed with each other in the head unit 140, as will be described with reference to FIGS. 3 and 4.

Figure 3:
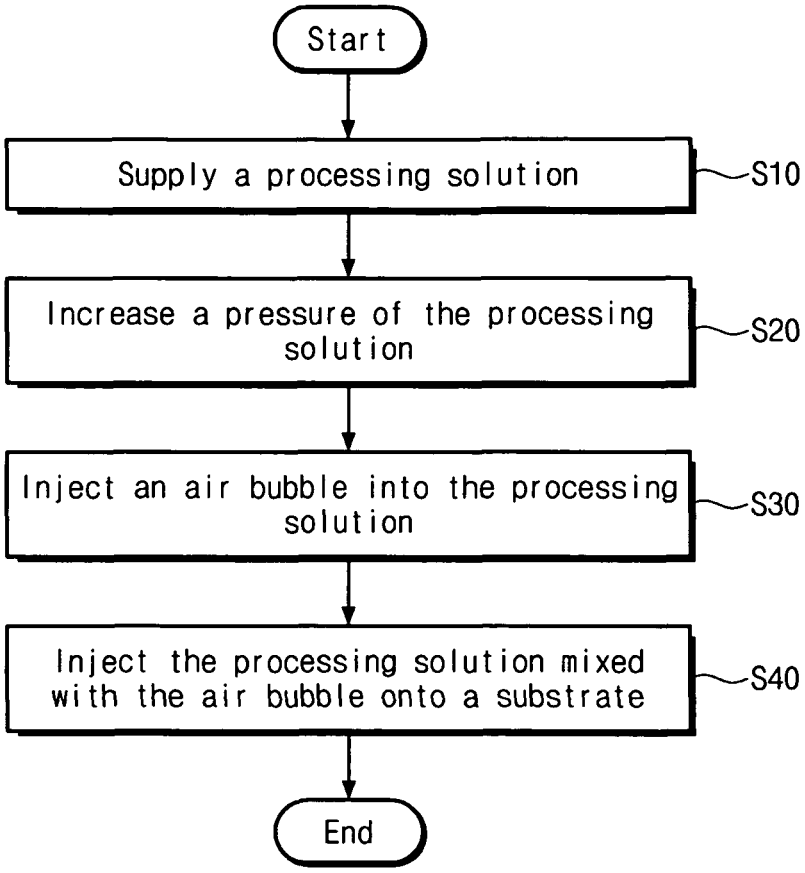

FIG. 3 illustrates a flow chart of a method of operating a substrate processing apparatus according to example embodiments. FIG. 4 illustrates a sectional view of a head unit of the substrate processing apparatus shown in FIG. 1

Figure 4:
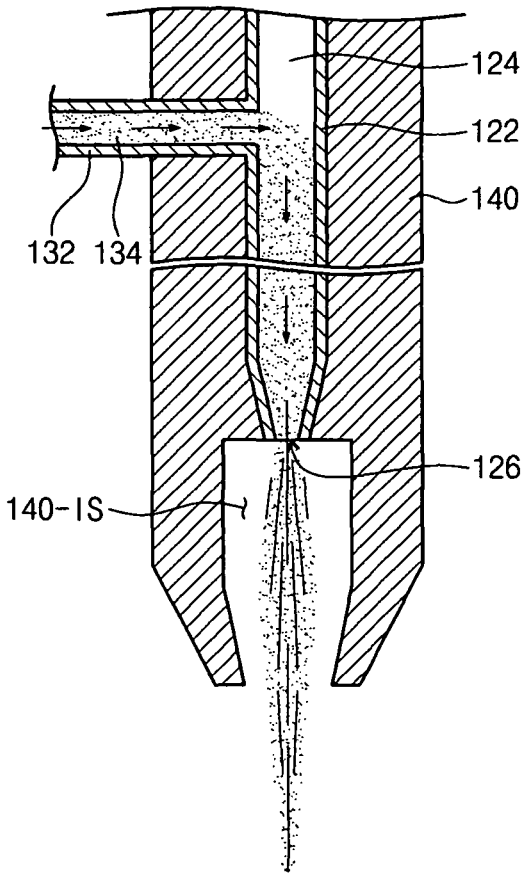

Referring to FIGS. 1, 3 and 4, the first conduit 122 may include a first terminal and a second terminal. The first terminal of the first conduit 122 may be connected to the processing solution supplying portion 120. The processing solution 124 may be delivered from the processing solution supplying portion 120 to the first conduit 122 via the first terminal of the first conduit 122. The second terminal of the first conduit 122 may be positioned within the head unit 140. The first conduit 122 may have an opening 126 provided at the second terminal. The opening 126 of the first conduit 122 may be positioned within the head unit 140. The width of the portion of the first conduit 122 that is within the head unit 140 near the opening 126, may be narrower than other portions of the first conduit 122. In other words, the first conduit 122 may be tapered toward the opening 126.

The second conduit 132 may include a first terminal and a second terminal. The first terminal of the second conduit 132 may be connected to the gas supplying portion 130. The gas 134 may be delivered from the gas supplying portion 130 to the second conduit 132 via the first terminal of the second conduit 132. The second terminal of the second conduit 132 may be connected to the first conduit 122. In some embodiments, the second terminal of the second conduit 132 may be disposed within the head unit 140 and be connected to a portion of the first conduit 122 adjacent to the second terminal. The gas 134 may be injected the first conduit 122 via the second terminal of the second conduit 132 and mixed with the processing solution 124.

The head unit 140 may include an empty internal space 140-IS therein (FIG. 4). The processing solution 124 mixed with the gas 134 may be injected onto the substrate 112 via the opening 126 of the second terminal of the first conduit 122 and the internal space 140-IS.

Referring to FIG. 3, the processing solution 124 may be supplied from an external storage into the processing solution supplying portion 120 (in S10). As described above, the processing solution 124 may contain water and an abrasive material.

The processing solution supplying portion 120 may include a pressure source to increase a pressure of the processing solution 124 (in S20), i.e., above an ambient pressure. For instance, the processing solution supplying portion 120 may include a high pressure pump to increase the pressure of the processing solution 124. The processing solution 124, once pressurized by the pressure source, may be supplied into the first conduit 122 via the first terminal of the first conduit 122. Thus, the processing solution 124 having increased pressure may be flowed through the first conduit 122.

The gas 134 may be injected into the processing solution 124 flowing through the first conduit 122 (in S30). For instance, the gas supplying portion 130 may be operated to supply the gas 134 into the second conduit 132 via the first terminal of the second conduit 132. The gas 134 may be supplied into the second conduit 132 or an air bubble may be flowed into the first conduit 122 via the second terminal of the second conduit 132, and be mixed into the processing solution 124.

The processing solution 124 mixed with the gas 134 may be injected or sprayed onto the substrate 112 via the opening 126 of the first conduit 122 and the internal space 140-IS of the head unit 140 (in S40). The substrate 112 may be cut or cleaned by the processing solution 124 mixed with the gas 134.

As described above, the processing solution 124 mixed with the gas 134 may be used to cut the processing target object or to remove contaminants from the processing target object. According to an embodiment, the gas 134 may be mixed into the processing solution 124. As such, the amount of the processing solution 124 consumed during the cutting or cleaning process may be less than an amount of processing solution 124 consumed when the gas 134 is not mixed into the processing solution 124. In other words, the gas 134 mixed into the processing solution 124 may make it possible to increase the injection pressure of the processing solution 124 enough to effectively perform the cutting or cleaning process, without an excessive consumption of the processing solution 124. Thus, consumption of water and/or the abrasive material may, thereby, be reduced, and the substrate processing apparatus may be operated with low cost.

In other embodiments, the processing solution 124 mixed with the gas 134 may be injected onto the substrate 112 via a nozzle, as will be described with reference to FIG. 5.

Figure 5:
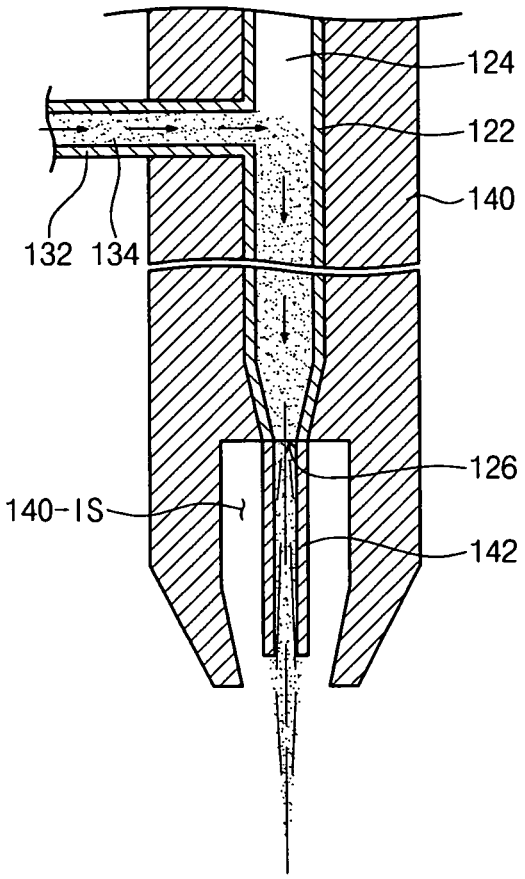

FIG. 5 illustrates a sectional view of a head unit of a substrate processing apparatus according to modified embodiments.

Referring to FIG. 5, a nozzle 142 may be connected to the opening 126 of the first conduit 122, which was described with reference to FIG. 4. The nozzle 142 may be disposed in the internal space 140-IS provided by the head unit 140. The processing solution 124 mixed with the gas 134 may be injected or sprayed from the nozzle 142 onto the substrate 112 via the opening 126 of the first conduit 122.

In the afore-described embodiments, the processing solution 124 may include water and an abrasive material. Alternatively, the processing solution 124 may not include the abrasive material, when it is, for instance, used for realizing a display device substrate. These embodiments will be described with reference to FIGS. 6 and 7.

Figure 6:
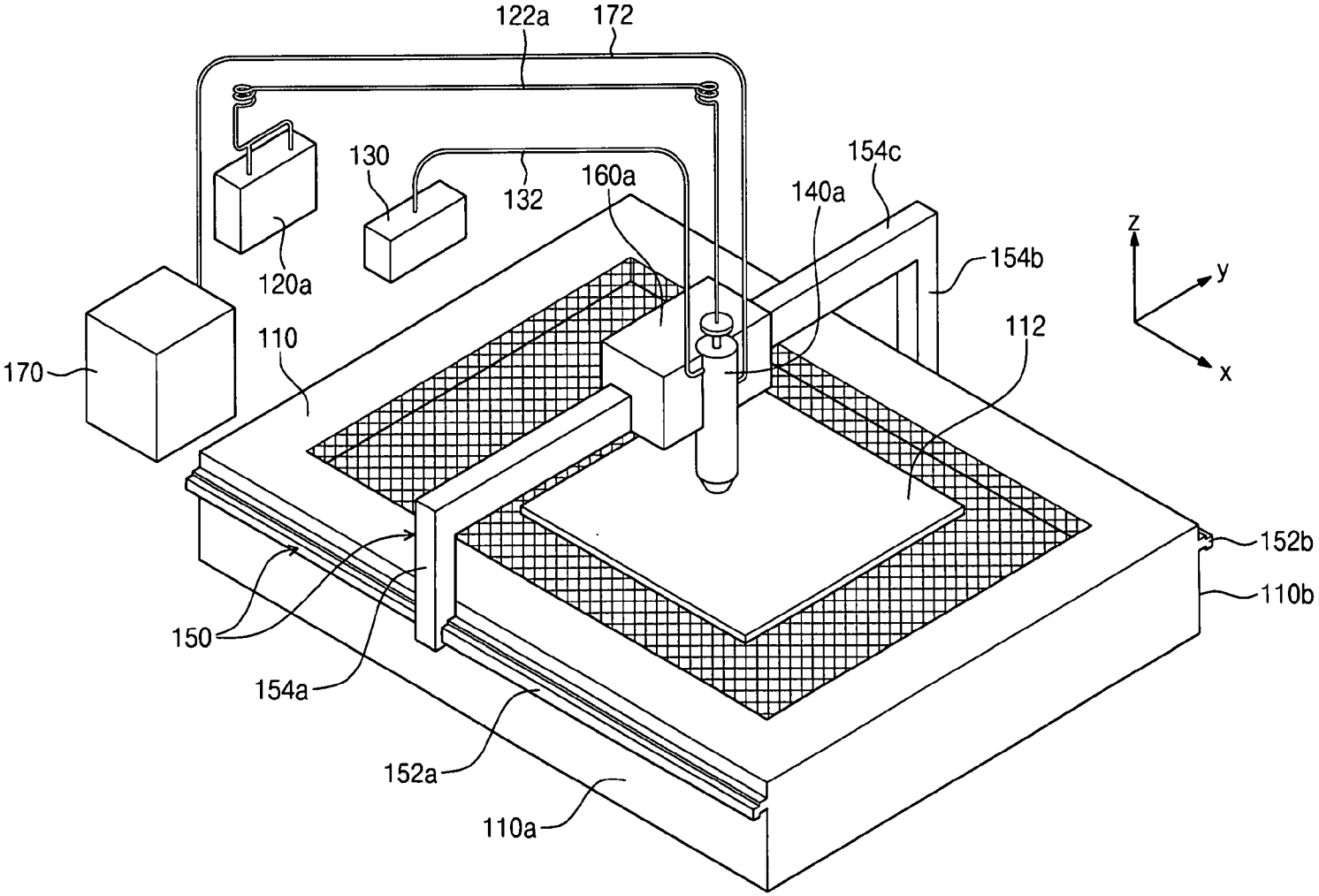
Figure 7:
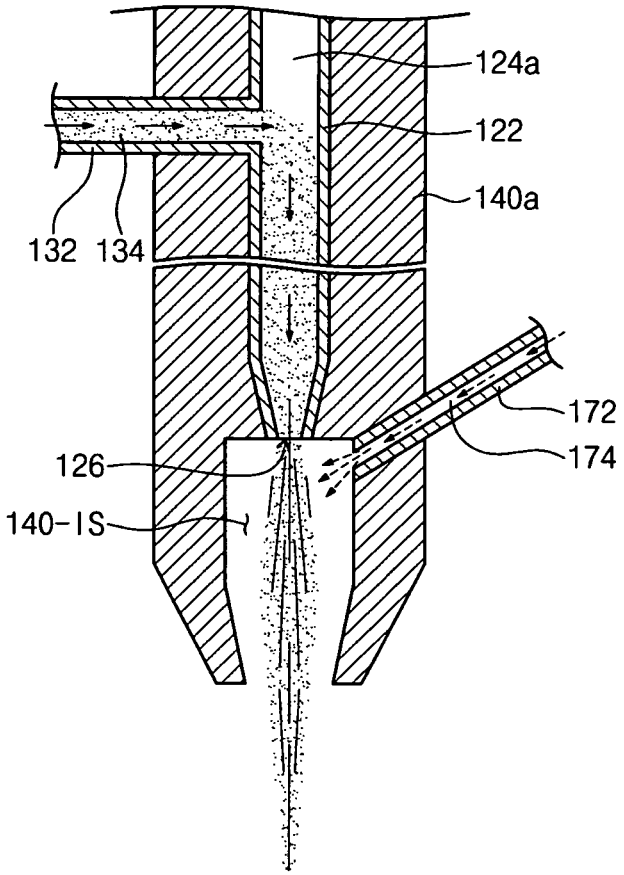

FIG. 6 illustrates a perspective view of a substrate processing apparatus according to other example embodiments. FIG. 7 illustrates a sectional view of a head unit of the substrate processing apparatus shown in FIG. 6. To avoid repetition, a description of elements having the same technical features as corresponding elements previously described with reference to FIGS. 1 through 5 is omitted.

Referring to FIGS. 6 and 7, a substrate processing apparatus according to other example embodiments may include a supporter 110 configured to support a processing target object, a processing solution supplying portion 120*a* configured to supply a processing solution 124*a*, a gas supplying portion 130 configured to supply a gas 134, a head unit 140*a* configured to inject or spray the processing solution 124*a* mixed with the gas 134, first and second transferring units 150 and 160 configured to transfer the head unit 140*a*, and an abrasive material supplying portion 170 configured to supply an abrasive material 174.

The supporter 110, the gas supplying portion 130, the first transferring unit 150, and the second transferring unit 160 may have the same technical feature as the corresponding elements, denoted by the same reference numerals, of the embodiments described with reference to FIG. 1.

The processing solution supplying portion 120*a* may supply the processing solution 124*a* to the head unit 160*a* via a first conduit 122*a*. In some embodiments, the processing solution 124*a* may contain water. The first conduit 122*a* may include a first terminal connected to the processing solution supplying portion 120*a* and a second terminal disposed within the head unit 140*a*. The processing solution 124*a* may be supplied from the processing solution supplying portion 120*a* to the second terminal of the first conduit 122*a* via the first terminal of the first conduit 122*a*. In addition, the first conduit 122*a* may include an opening 126 provided at the second terminal of the first conduit 122*a*. The opening 126 of the first conduit 122*a* may be disposed within the head unit 140*a*.

The gas supplying portion 130 may supply the gas 134 into the processing solution 124*a* flowing through the first conduit 122*a* via a second conduit 132 connected to the first conduit 122*a*.

The head unit 140*a* may include an empty internal space 140-IS therein. The processing solution 124*a* mixed with the gas 134 may be injected or sprayed onto the substrate 112 via the opening 126 of the first conduit 122*a* and the internal space 140-IS.

The abrasive material supplying portion 170 may supply the abrasive material 174 to the head unit 140*a* via a third conduit 172 connected to the head unit 140*a*. The third conduit 172 may include a first terminal and a second terminal. The first terminal of the third conduit 172 may be connected to the abrasive material supplying portion 170. At least a portion of the second terminal of the third conduit 172 may be disposed within the head unit 140*a* and may be configured to inject or spray the abrasive material 174 into the internal space 140-IS of the head unit 140*a*. The abrasive material 174 may be supplied onto the substrate 112 along with the processing solution 124*a* to grind the substrate 112.

The second transferring unit 160*a* may be configured to be movable along the second direction. In some embodiments, the second transferring unit 160 may be coupled with the first transferring unit 150 that is movable along the first direction. The head unit 140*a* may be configured to be movable along the third direction and be coupled to the third transferring unit. As a result, the head unit 140*a* may be three-dimensionally movable, during injecting or spraying of the processing solution 124*a* mixed with the gas 134 onto the substrate 112.

According to example embodiments, a processing solution mixed with a gas may be used to cut a processing target object or to remove contaminants from the processing target object. The gas mixed into the processing solution makes it possible to increase an injection pressure of the processing solution enough to effectively perform the cutting or cleaning process, without an excessive consumption of the processing solution. As a result, the substrate processing apparatus can be operated with low cost.

Embodiments of the inventive concepts provide an apparatus capable of processing a substrate with a low cost and a method of operating the same.

Other embodiments of the inventive concepts provide a substrate processing apparatus capable of being operated with a low operation cost and a method of operating the same.

While example embodiments have been particularly shown and described, it will be understood by one of ordinary skill in the art that variations in form and detail may be made therein without departing from the spirit and scope of the attached claims.

What is claimed is:

1. A substrate processing apparatus, comprising:

a first conduit configured to supply a processing solution to a substrate loaded on a supporter, the first conduit having a first terminal and a second terminal;

a second conduit in direct fluid communication with the first conduit between the first terminal and the second terminal, the second conduit configured to supply a gas to the first conduit to be mixed with the processing solution in a mixing portion of the first conduit, and a head unit including an internal space downstream of the mixing portion which is a space inside the first conduit, wherein the first conduit includes an opening to permit the processing solution mixed with the gas to be injected onto the substrate, and wherein the internal space surrounds the opening of the first conduit.

2. The substrate processing apparatus of claim 1, wherein the processing solution includes water and an abrasive material.

3. The substrate processing apparatus of claim 1, wherein:

the supporter includes a top surface for supporting the substrate, and the head unit is movable along a vertical direction perpendicular to the top surface of the supporter.

4. The substrate processing apparatus of claim 3, wherein the processing solution mixed with the gas is injected onto the substrate via the internal space.

5. The substrate processing apparatus of claim 4, further comprising a third conduit coupled to the head unit, the third conduit configured for supplying an abrasive material into the internal space of the head unit.

6. The substrate processing apparatus of claim 3, further comprising:

a first transferring unit configured to move the head unit along a first direction, the first transferring unit including a guide rail extending along the first direction; and a support load coupled with the guide rail, the support load being movable along the first direction.

7. The substrate processing apparatus of claim 6, wherein:

the supporter includes first and second sidewalls facing each other and extending along the first direction, the guide rail includes first and second guide rails provided on the first and second sidewalls of the supporter, respectively, and the support load includes a first portion coupled with the first guide rail to extend along a third direction, a second portion coupled with the second guide rail to extend along the third direction, and a third portion connecting the first and second portions with each other and extending along a second direction, the first and second directions are perpendicular to each other, and the third direction is perpendicular to the top surface of the supporter.

8. The substrate processing apparatus of claim 7, further comprising a second transferring unit coupled with the third portion of the support load and configured to move the head unit along the second direction.

9. The substrate processing apparatus of claim 1, wherein the substrate includes at least one of a touch screen panel, a glass substrate, and a flexible substrate, and the supporter is configured to support at least one of the touch screen panel, the glass substrate, and the flexible substrate.

10. The substrate processing apparatus of claim 9, wherein the supporter is configured to support a plurality of the substrates loaded thereon, and the opening is configured to permit the processing solution mixed with the gas to be injected onto the plurality of the substrates.

11. The substrate processing apparatus of claim 1, further comprising a processing solution supplying portion in fluid communication with the first conduit and configured to supply the processing solution at pressure higher than ambient pressure.

12. A method of processing a substrate, comprising:

increasing a pressure of a processing solution supplied into a first conduit to above an ambient pressure;

supplying a gas into the processing solution to form a processing solution mixed with the gas in the first conduit; and injecting the processing solution mixed with the gas onto the substrate using a substrate processing apparatus, comprising:

the first conduit configured to supply the processing solution to the substrate loaded on a supporter, the first conduit having a first terminal and a second terminal;

a second conduit in direct fluid communication with the first conduit between the first terminal and the second terminal, the second conduit configured to supply the gas to the first conduit to be mixed with the processing solution in a mixing portion of the first conduit, and a head unit including an internal space downstream of the mixing portion which is a space inside the first conduit, wherein the first conduit includes an opening to permit the processing solution mixed with the gas to be injected onto the substrate, and wherein the internal space surrounds the opening of the first conduit.

13. The method of claim 12, wherein the injecting of the processing solution mixed with the gas includes injecting an abrasive material onto the at least one substrate, along with the processing solution mixed with the gas.

14. The method of claim 12, wherein the at least one substrate includes a plurality of substrates, and the processing solution mixed with the gas is used to cut the plurality of substrates.

15. The method of claim 14, wherein the plurality of substrates is curvedly cut to form a curved edge.

16. The method of claim 12, wherein the processing solution mixed with the gas is used to remove contaminants from the substrate.

* * * * *